United States Patent [19]

Fleming

[11] Patent Number: 4,715,439

[45] Date of Patent: Dec. 29, 1987

[54] WELL CAP

[76] Inventor: Roy E. Fleming, Rte. 1, Box 741, McKenney, Va. 23872

[21] Appl. No.: 21,215

[22] Filed: Mar. 3, 1987

[51] Int. Cl.[4] ..... E21B 33/04

[52] U.S. Cl. ..... 166/68; 166/81

[58] Field of Search ..... 166/68, 68.5, 79, 81, 166/92, 93, 94, 97, 57

[56] References Cited

U.S. PATENT DOCUMENTS

| | | | |
|---|---|---|---|
| 948,329 | 2/1910 | Hunting | 166/68 |
| 1,917,821 | 7/1933 | Branstrator | 166/68.5 |
| 2,179,191 | 11/1939 | McWilliams | 166/92 |
| 3,525,399 | 8/1970 | Bayless et al. | 166/57 X |
| 4,457,448 | 7/1984 | Beagell | 166/93 X |
| 4,664,185 | 5/1987 | Barnard | 166/68 X |

*Primary Examiner*—Stephen J. Novosad
*Assistant Examiner*—William P. Neuder
*Attorney, Agent, or Firm*—Norman B. Rainer

[57] ABSTRACT

A covering is provided for the upper extremity of a circular cylindrical casing wall of a well for potable water. The covering supports a pump positioned within the well and provides thermal insulation so that the water will not freeze when pumped from the well to underground distributor lines. The covering or cap is comprised of a lower member having an outer vertical sidewall and interiorly disposed support beams, an upper member which seals the lower member, and a cylindrical tube that transfers water from the well to underground distributor lines.

5 Claims, 4 Drawing Figures

WELL CAP

BACKGROUND OF THE INVENTION

This invention relates to wells designed to accumulate potable subterranean water for pumped delivery to an elevation above ground level, and more particularly concerns improvements in the manner of covering such wells and the delivery of water therefrom.

Most wells for the accumulation and delivery of subterranean water utilize a circular cylindrical casing wall of large diameter which extends vertically downward from ground level to a depth where water will permeate into the lower extremity of the casing. The casing is generally fabricated of a series of concrete sections in stacked abutment. Interlocking flanges at the extremities of each concrete section may be utilized to seal the casing against undesired entry of surface water, namely water which has not been filtered by extensive passage through porous underground strata.

In many instances, the pump that delivers water upwardly from the interior of the casing is positioned outside the casing, and causes the water to be conveyed through a pipe that penetrates the casing and extends to communication with the pump. However, the site of such penetration of the well casing by the pipe is susceptible to leakage of surface water into the interior of the well casing.

Although the use of a pump positioned within the well casing may obviate the need to penetrate the casing, such installation of the pump in a servicable manner is difficult, and the water must usually be piped above the top of the casing where it is subject to freezing within the pipe.

It is accordingly an object of this invention to provide a covering cap for a well, said cap facilitating the positioning of a submersible pump within the well.

It is another object of this invention to provide a well cap as in the foregoing object having provision for preventing the freezing of water delivered from said pump.

It is a further object of the present invention to provide a well cap of the aforesaid nature of rugged and durable construction amenable to low cost manufacture.

These objects and other objects and advantages of the invention will be apparent from the following description.

SUMMARY OF THE INVENTION

The above and other beneficial objects and advantages are accomplished in accordance with the present invention by a well cap adapted to be positioned atop the circular cylindrical casing of a well which accumulates potable subterranean water, said well cap comprising:

(A) a lower member having (1) a continuous outer sidewall of uniform height between upper and lower extremities and adapted to be vertically disposed in a perimeter comprised of a large circular arc and an outlying region extending radially and horizontally away from the large circular arc and terminating in an extremity shaped as an arc of a circle of smaller radius than the radius of said large arc, (2) a horizontally disposed shelf attached to the lower extremity of said outer sidewall and extending a uniform distance inwardly with respect to said perimeter, (3) a floor panel disposed horizontally within said outlying region in coplanar alignment with said shelf and having a circular aperture adjacent the circular arc extremity of said outlying region, (4) a first support beam extending diametrically through the center of said large circular arc and joined to opposed sites of said shelf, (5) a second support beam joined to the center of said first support beam and extending to the circular aperture of said outlying region while resting upon said floor panel, and (6) self-supporting thermal insulation disposed upon said shelf about said perimeter to a height even with the upper extremity of said sidewall, (B) an upper member comprised of (1) a flat panel having a perimeter which matches the perimeter of the outer sidewall of said lower member, (2) a continuous boundary wall of uniform height perpendicularly disposed to said flat panel about its entire perimeter, and (3) self-supporting thermal insulation which covers said flat panel to a height substantially even with the height of said boundary wall, and (C) a circular cylindrical tube having an upper extremity which joins the circular aperture of said outlying region and an annular zone of self-supporting thermal insulation bonded to the inside surface of said tube, said tube being adapted to extend vertically into the ground adjacent said well casing, whereby (D) when the upper member is seated upon the lower member, and the lower member is seated upon said well casing, a pump suspended within said well by said first support beam can pump water through a conduit which extends upwardly above said first support beam, runs horizontally toward the circular aperture in said outlying region, thence downwardly through said tube to a depth below the prevailing frost line and thence to a distributor line which extends to the point of ultimate water use, the water in said conduit being protected from freezing during its transfer from the well to said distributor line.

In preferred embodiments of the present invention a retaining wall is disposed within the perimeter of the lower member, extending upwardly from the shelf in parallel disposition to said outer sidewall and of equal height therewith. The retaining wall forms with said shelf and outer sidewall a continuous trough which may be filled with thermal insulation material. Said thermal insulation material is preferably a closed cell foam of a synthetic polymer auch as polystyrene, polyurethane, polyethylene, neoprene, and the like. The chosen polymer is preferably resistant to water and unaffected by long exposure to extreme weather temperatures. A storage tank containing water elevated from the bottom of the well by the pump may also be suspended from the lower member for protected storage within the well casing.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
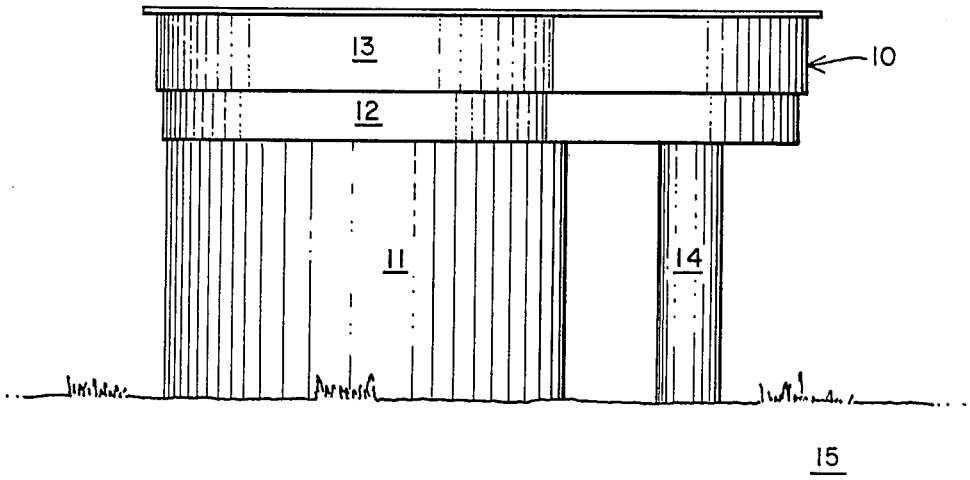
FIG. 1 is a side view of an embodiment of the well cap of this invention shown in operative position upon the upper extremity of a circular cylindrical well casing.

Referring to FIG. 1, an embodiment of a well cap 10 of this invention is shown operatively associated with the upper extremity of a circular cylindrical well casing 11. The well cap is comprised in general of lower member 12, upper member 13, and tube 14 which perpendicularly enters the ground 15 adjacent casing 11. Typical well casings will have a diameter between about 4 and 30 inches.

Figure 2:
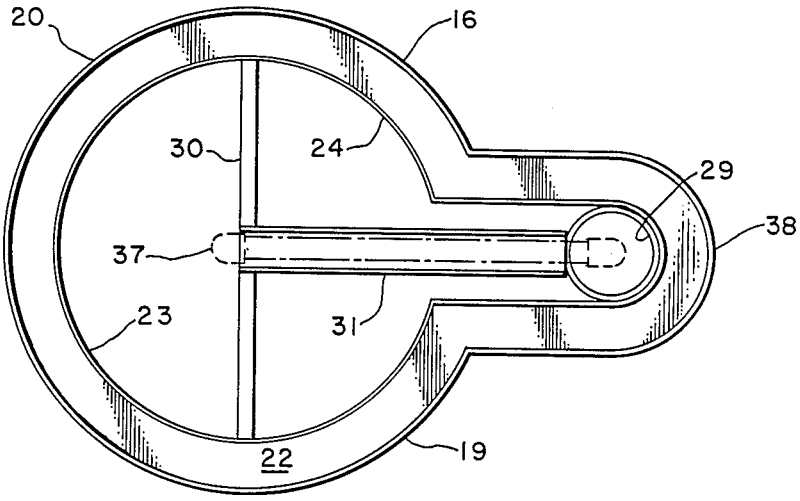
FIG. 2 is a top perspective view of the lower member of the well cap of FIG. 1.
Figure 3:
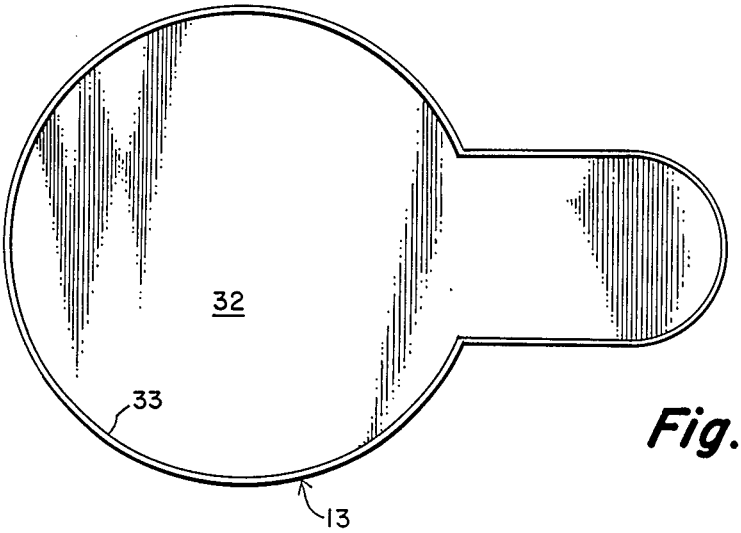
FIG. 3 is a plan view of the underside of the upper member of the well cap of FIG. 1.
Figure 4:
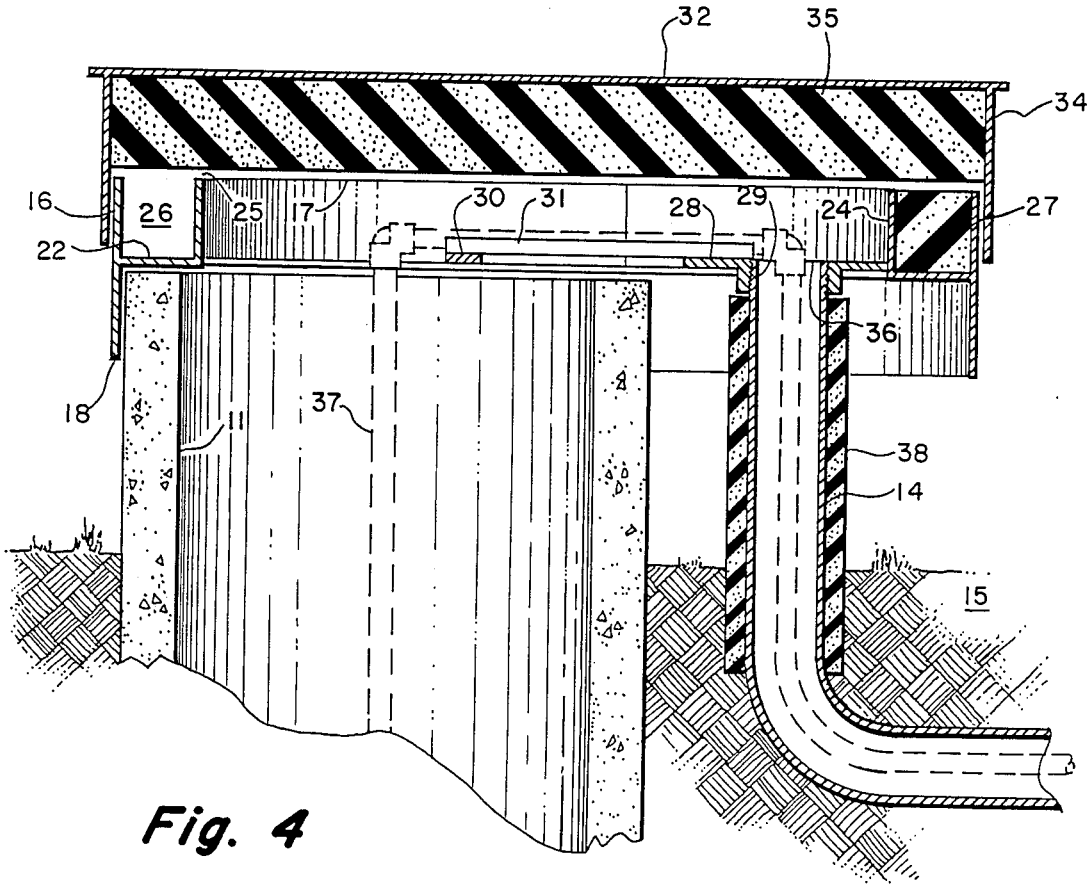
FIG. 4 is a vertical sectional view of the embodiment of FIG. 1.

As best shown in FIGS. 2 and 4, lower member 12 is comprised of continuous outer sidewall 16, preferably of sheet metal of uniform height between upper and lower extremities 17 and 18, respectively. The sidewall is adapted to be vertically disposed in a perimeter 19 comprised of a large circular arc 20 and an outlying region 21 extending radially and horizontally away from circular arc 20 and terminating in an extremity 38 shaped as an arc of a circle of smaller radius than the radius of said large arc 20.

A horizontally disposed shelf 22 is attached as by welding to said outer sidewall at about mid-height thereof. Shelf 22 extends a uniform distance inwardly from perimeter 19 so that its distal edge 23 is parallel to the contour of the outer sidewall. A retaining wall 24 is welded to the distal edge 23 of the shelf and extends upwardly therefrom in parallel disposition to said outer sidewall. The upper edge 25 of said retaining wall is coplanar with the upper extremity 17 of sidewall 16. A trough 26, defined by shelf 22, retaining wall 24 and outer sidewall 16, is filled with a thermally insulative material 27. The lower portion of sidewall 16 disposed below shelf 22 serves as a sleeve-like structure adapted to embrace the exterior surface of the casing wall.

A floor panel 28 is disposed horizontally within said outlying region in resting abutment with said shelf. A circular aperture 29 is positioned within floor panel 28 adjacent extremity 38 of said outlying region.

A first support beam 30 extends across circular arc 20 as a diameter thereof and perpendicularly disposed to the radial direction in which outlying region 21 extends from large circular arc 20. Support beam 30 is preferably welded to opposed sites of distal edge 23 of the shelf.

A second support beam 31 is welded to the center of first support beam 30 and extends to aperture 29 while resting upon floor panel 28.

Upper member 13 is comprised of a flat panel 32 having a perimeter 33 which matches the perimeter 19 of the outer sidewall of the lower member. A continuous boundary wall 34 of uniform height is perpendicularly disposed to the underside of panel 32 about its entire perimeter and is adapted to make close-fitting sliding engagement with the upper exterior portion of the sidewall. A self-supporting thermal insulation 35 covers the underside of panel 32 to a uniform height.

Tube 14, which may be fabricated of a plastic such as polyvinylchloride, has an upper extremity 36 which is sealed to aperture 29 of outlying region 21. Tube 14 is vertically oriented and penetrates into the ground adjacent the well casing. An annular zone of self-supporting thermal insulation 39 is bonded to the outside surface of the tube. The lower extremity of tube 14 extends to a level below the frost line for the particular location of the well so that underground pipelines can distribute the water to desired locations. The several places in the well cap of this invention where insulation is used preferably utilizes insulation thicknesses in the range of 2 to 3 inches.

In operation, a pump suspended from support beam 30 delivers water upwardly through conduit 37 which passes over beam 30, proceeds horizontally to aperture 29, and then descends through tube 14. By virtue of the specialized features of the well cap of this invention, the pumped water is protected from freezing during its transit from the well to its ultimate destination.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention what is claimed is:

1. A well cap adapted to be positioned atop the circular cylindrical casing of a well which accumulates potable subterranean water, said well cap comprising:

(A) a lower member having (1) a continuous outer sidewall of uniform height between upper and lower extremities and configured to be vertically disposed in a perimeter comprised of a large circular arc and an outlying region extending radially and horizontally away from the large circular arc and terminating in an extremity shaped as an arc of a circle of smaller radius than the radius of said large arc, (2) a horizontally disposed shelf attached to said outer sidewall and extending a uniform distance inwardly with respect to said perimeter, (3) a floor panel disposed horizontally within said outlying region in substantially coplanar alignment with said shelf and having a circular aperture adjacent the circular arc extremity of said outlying region, (4) a first support beam extending diametrically through the center of said large circular arc and joined to opposed sides of said shelf, (5) a second support beam joined to the center of said first support beam and extending to the circular aperture of said outlying region while resting upon said floor panel, and (6) thermal insulation disposed upon said shelf about said perimeter to a height even with the upper extremity of said sidewall, (B) an upper member comprised of (1) a flat panel having a perimeter which matches the perimeter of the outer sidewall of said lower member, (2) a continuous boundary wall of uniform height perpendicularly disposed to said flat panel about its entire perimeter, and (3) self-supporting thermal insulation which covers said flat panel to a uniform height, and (C) a circular cylindrical tube having an upper extremity which joins the circular aperture of said outlying region and a continuous annular zone of self-supporting thermal insulation, said tube being oriented to extend vertically into the ground adjacent said well casing, whereby (D) when the upper member is seated upon the lower member, and the lower member is seated upon said well casing, a pump suspended within said well by said first support beam can pump water through a conduit which extends upwardly above said first support beam, runs horizontally toward the circular aperture in said outlying region, thence downwardly through said tube to a depth below the prevailing frost line and thence to a distributor line which extends to the point of ultimate water use, the water in said conduit being protected from freezing during its transfer from the well to said distributor line.

2. The well cap of claim 1 wherein a retaining wall is disposed within the perimeter of the lower member, extending upwardly from the shelf in parallel disposition to said outer sidewall and of equal height therewith, thereby forming a continuous trough which contains said thermal insulation.

3. The well cap of claim 1 wherein said thermal insulation is a closed cell foam of a synthetic polymer.

4. The well cap of claim 1 wherein said shelf is attached to said sidewall at an elevation located about mid-height of said sidewall, the portion of said sidewall disposed below said shelf serving to embrace the exterior surface of said cylindrical casing in a manner whereby the upper extremity of the casing abuts against the underside of said shelf.

5. The well cap of claim 1 wherein the boundary wall of said upper member is configured to surround an upper portion of the sidewall of said lower member in close-fitting association therewith.

* * * * *